US005169084A

United States Patent [19]

Pötter et al.

[11] Patent Number: 5,169,084

[45] Date of Patent: Dec. 8, 1992

[54] APPARATUS FOR WINDING WEBS ON CORE TUBES

[75] Inventors: Dietmar Pötter, Westerkappeln; Manfred Twente, Tecklenburg, both of Fed. Rep. of Germany

[73] Assignee: Windmöller & Hölscher, Lengerich, Fed. Rep. of Germany

[21] Appl. No.: 424,100

[22] Filed: Oct. 20, 1989

[30] Foreign Application Priority Data

Oct. 24, 1988 [DE] Fed. Rep. of Germany ..... 3836195

[51] Int. Cl.[5] ..... B65H 16/06; B65H 18/04; B21C 47/04

[52] U.S. Cl. ..... 242/68.4; 242/68

[58] Field of Search ..... 242/68.4, 68.3, 68.2, 242/68, 72.1, 72 R

[56] References Cited

U.S. PATENT DOCUMENTS

| | | | |
|---|---|---|---|
| 888,395 | 5/1908 | Freborg | 242/68.4 |
| 915,111 | 3/1909 | Price | 242/68.4 |
| 1,796,534 | 3/1931 | Pope | 242/68.4 |
| 2,107,068 | 10/1935 | Lamatsch | 242/68.4 |
| 2,363,678 | 11/1944 | Lane | 242/68.4 |
| 2,446,690 | 8/1948 | Carpenter et al. | 242/68.2 |
| 2,514,970 | 7/1950 | Prickett | 242/68.4 |
| 2,898,056 | 8/1959 | Triquet | 242/58.2 |
| 2,968,448 | 1/1961 | Drum | 242/68.4 |
| 2,977,128 | 3/1961 | Judelson | 242/68.4 |
| 3,097,808 | 7/1963 | Williams | 242/68.2 |
| 3,157,405 | 11/1964 | Hafemeister | 242/68.2 X |
| 3,211,395 | 10/1965 | Slijkhuis | 242/68.4 |
| 3,279,716 | 10/1966 | Huck et al. . | |
| 3,837,591 | 9/1974 | Clarke | 242/68.4 |
| 3,941,328 | 3/1976 | Johnson | 242/68.4 |
| 4,177,959 | 12/1979 | Lancaster et al. | 242/58.2 |
| 4,210,294 | 7/1980 | Jansen | 242/72.1 |
| 4,289,418 | 10/1981 | Westin et al. | 242/68.4 X |
| 4,358,066 | 11/1982 | Deutschle et al. | 242/68.4 |
| 4,460,135 | 7/1984 | Hirakawa et al. | 242/68.4 |
| 4,483,493 | 11/1984 | Schonmeier | 242/68.4 X |
| 4,697,756 | 10/1987 | Kofler | 242/68.4 X |
| 4,793,567 | 12/1988 | Weiss et al. | 242/68.4 X |

FOREIGN PATENT DOCUMENTS

| | | | |
|---|---|---|---|
| 956214 | 1/1957 | Fed. Rep. of Germany | 242/68.4 |
| 2261559 | 12/1972 | Fed. Rep. of Germany | 242/68.4 |
| 0188795 | 7/1986 | Fed. Rep. of Germany . | |
| 433397 | 9/1967 | Switzerland . | |
| 464965 | 12/1968 | Switzerland . | |
| 236975 | 11/1969 | U.S.S.R. | 242/68.4 |
| 458360 | 3/1975 | U.S.S.R. | 242/68.4 |
| 536884 | 5/1941 | United Kingdom . | |

*Primary Examiner*—Stuart S. Levy
*Assistant Examiner*—Joseph A. Rhoa
*Attorney, Agent, or Firm*—Keck, Mahin & Cate

[57] ABSTRACT

A device for winding webs on core tubes includes mutually opposite trunnions (38), which are aligned with each other and rotatably mounted in a machine frame and at their confronting ends are provided with mandrels, which are adapted to be inserted into the core tubes and to be forced against said core tubes. Each of said trunnions is mounted in an axially displaceable bearing sleeve (31). The apparatus also comprises drive means for axially reciprocating at least one of the mutually opposite trunnions. The trunnion is axially slidably and non-rotatably mounted in the bearing sleeve, and the latter is axially slidably and non-rotatably mounted in a bearing bushing (28), which is rotatably mounted in the machine frame.

3 Claims, 2 Drawing Sheets

APPARATUS FOR WINDING WEBS ON CORE TUBES

BACKGROUND OF THE INVENTION

1. Field of the Invention

This invention relates to an apparatus for winding webs on core tubes, which apparatus comprises mutually opposite trunnions, which are aligned with each other and rotatably mounted in a machine frame and at their confronting ends are provided with mandrels, which are adapted to be inserted into the core tubes and to be forced against said core tubes, wherein each of said trunnions is mounted in an axially displaceable bearing sleeve and the apparatus also comprises drive means for axially reciprocating at least one of the mutually opposite trunnions.

2. Description of the Prior Art

U.S. Pat. No. 32,79,716 discloses a so-called reversing winder, which is provided with a peripheral drive and in which a shaft that is rotatably mounted in the machine frame is provided with mutually opposite carrying arms, which are 180 degrees and are provided each at their free ends with aligned trunnions, which are provided at their inner ends with fixed mandrels, between which the core tubes are held. To permit the core tubes to be fitted on the mandrels of rotatably mounted trunnions and to permit the wound complete coils to be removed, the trunnions must be axially slidably mounted so that they can be moved apart to such an extent that the tubes with the coils are released by the mandrels.

Swiss Patent Specification No. 464,965 discloses an apparatus which is of the kind described first hereinbefore and in which the trunnion which carries the mandrel is rotatably mounted in a bearing sleeve, which is axially slidably mounted in a bore of a carrying arm axially slidably mounted in a bore of a carrying arm of a coil changer. Owing to that arrangement the trunnion can be extended and can be retracted to such an extent that the mandrel is almost entirely received by the bore of the trunnion. That known apparatus may operate satisfactorily if the length of each core tube and of each coil is approximately as large as the distance between the trunnions so that the core tubes can be mounted and the coils can be removed when the trunnions have axially been displaced by a length which equals the length or twice the length of the mandrels. Owing to said small displacements the trunnions can be rotatably mounted closely behind the mandrels so that the trunnions have only short lever arms and will oppose a deflection of the trunnions under the weight of the coils and under the additional pressure forces exerted by possibly provided pressure-applying rollers or pressure-applying belts.

But if an apparatus of the kind known from Swiss Patent Specification No. 464,965 is required to produce a coil which has a small length and is large in diameter, it will be necessary for the bearing sleeve and the bore in the trunnion to have such a large length that the core tube can be sufficiently extended. But a bearing sleeve which has been extended to a large extent from the bore of the carrying arm will be subjected to strong bending forces so that the bearing sleeve must be sufficiently large in diameter for taking up such forces. As a result, the bearing sleeve may be larger in diameter than the mandrel and the pressure-applying rollers or pressure-applying belts must not be wider than the web which is to be wound up because otherwise the pressure-applying rollers or pressure-applying belts would bear on the bearing sleeves rather than on the core tubes which have been fitted on the mandrels. Another requirement to be met by a winder at the beginning of the winding operation resides in that the mandrels connected to the trunnions can be replaced by adapters which differ in diameter so that core tubes which are relatively large in diameter can also be used. In the apparatus disclosed in Swiss Patent Specification No. 464,965 the diameter of the mandrel or adapter must not exceed the diameter of the bearing sleeve so that the mandrel can be received by the bores of the carrying arms as the trunnions are moved apart. If larger mandrels or adapters were used, it would not be possible to wind coils which are so long that they occupy the entire space between the carrying arms because the usable space would then be reduced by the length of the mandrels.

SUMMARY OF THE INVENTION

For this reason it is an object of the invention to provide an apparatus which is of the kind described first hereinbefore and in which coils having different lengths can be wound whereas an unpermissible deflection of the trunnions need not be feared even when the coil is engaged by pressure-applying rollers or pressure-applying belts.

In an apparatus which is of the kind described first hereinbefore that object is accomplished in accordance with the invention in that the trunnion is axially slidably and non-rotatably mounted in the bearing sleeve, and the latter is axially slidably and non-rotatably mounted in a bearing bushing, which is rotatably mounted in the machine frame. In the apparatus in accordance with the invention an unpermissible deflection of the trunnion need not be feared even if the trunnion is relatively slender because it is slidably mounted in the bearing sleeve, which is also extensible so that the trunnion may have a much shorter free length whereas this will not decrease the extent to which the mandrel can be extended to the required extent. In the apparatus in accordance with the invention the trunnion and the bearing sleeve are virtually telescopically extensible out of the bearing bushing, which is rotatably mounted in the machine frame, so that the mandrels which carry the core tubes and the coils can be extended to different extents in adaptation to core tubes having different lengths and the trunnions have a smaller free length because they are axially slidably mounted in the bearing sleeves, which are so large in diameter that they can take up relatively strong bending forces.

Because in the apparatus in accordance with the invention the diameter of the trunnions may be smaller than the smallest diamter of the core tubes which can be secured to the associated mandrels, the pressure-applying rollers or the pressure-applying belts which can be used in the winding of coils having different widths may have a width which is selected in view of the largest possible width of the coils.

The trunnion is suitably movably mounted at its rear end portion in a ring, which is secured to a nut, into which a screw is screwed, which extends parallel to the trunnion and is rotatably mounted in the machine frame and operatively connected to a drive for rotating the screw. The trunnion can be axially moved in a simple manner by that screw drive.

In accordance with a further feature of the invention the trunnion has an axial bore and an actuating rod for expanding the mandrel is guided in said bore and is reciprocable by a piston, which is guided in a cylinder, which is connected at one end to the trunnion and is provided with a rotary lead-through for a supply and discharge of fluid.

The nut which constitutes a pin for mounting the bearing ring is suitably guided in a longitudinal slot of a guide tube, which is secured to the machine frame. That guide tube constitutes a tube for protecting the trunnion.

In accordance with a particularly preferred feature of the invention the bearing sleeve is provided at both ends with discs, which are formed with central bores through which the trunnion extends, and at least one compression spring is compressed between the outer rim of the inner disk and the bushing and urges the inner disk and the bushing apart. That arrangement will ensure that an extending of the trunnion into the space which is intended to accommodate the wound coil will cause the bearing sleeve to be extended first before the trunnion is extended out of the bearing sleeve to such an extent that the mandrel is sufficiently extended. The displacement of the bearing sleeve relative to the bearing bushing is limited by stops, which are constituted by the disks.

The rim of the outer disk in the bearing sleeve suitably constitutes a stop which bears on the end edge or the outer end face of a key, which is screw-connected to the bearing sleeve.

In a preferred embodiment the machine frame comprises a carrying wall, which is connected on its inside surface with a protective tube, which is approximately as large in diameter as the inner disk and which has such a length that the mandrel can be entirely received by said tube. In that case the apparature in accordance with the invention may be used to form wound coils which have a width that is equal to the distance between the confronting ends of the protective tubes. The inner disk constitutes a closure for the currently open portion of the protective tube and also as a stop for engaging the bearing bushing.

The mandrel is suitably detachably secured to the inner end of the trunnion. In that case the mandrel may consist of an adapter which matches a given diameter of the bore to be formed in a given inside diameter of the coil to be wound. The protective tube should be sufficiently large in diameter to receive even mandrels and adapters having the largest diameter which is contemplated.

Two opposite trunnions which are aligned with each other are suitably movably mounted in a bearing sleevd and bearing bushing.

The invention may be applied to special advantage to a centrally driven traversing winder, in which a plurality of pairs of aligned trunnions are movably mounted by means of bearing sleeves and bearing bushings mounted in mutually opposite disks, which are rotatably mounted in corresponding circular apertures or recesses in mutually opposite side walls of the machine frame.

DETAILED DESCRIPTION OF THE PREFERRED EMBODIMENT

Figure 1:
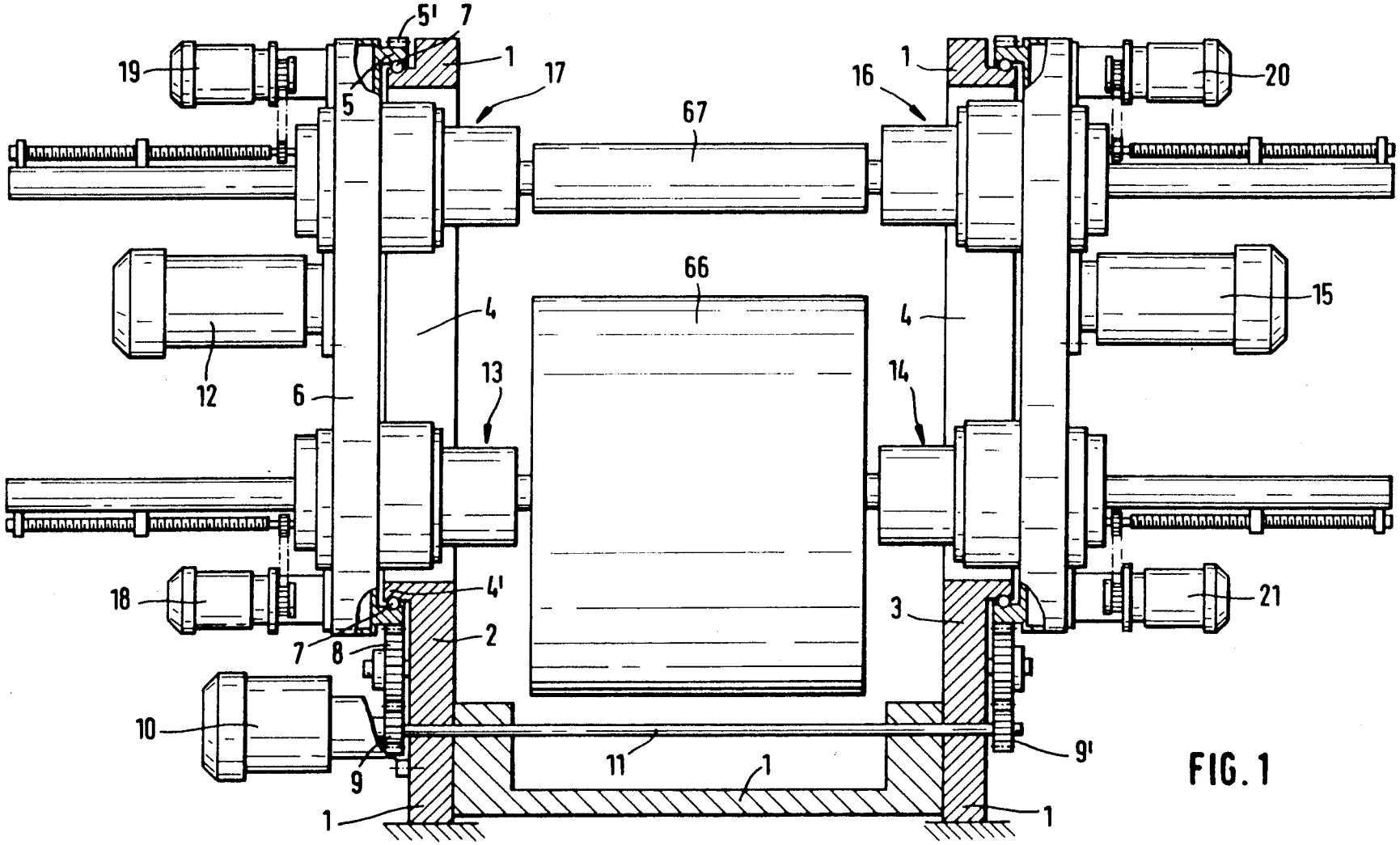
FIG. 1 is a front elevation showing a traversing winder.

An illustrative embodiment of the invention will now be explained more in detail with reference to the drawing.

A machine frame 1 comprises two side walls 2, 3, which are formed each with an aperture 4. Each of the side walls 2 and 3 is provided with an annular extension 4', which is embranced by a collar 5 of a hollow disk 6 with a ball bearing 7 interposed. The collar 5 is provided with external teeth 5', which mesh with an idler gear 8. The latter meshes with a pinion 9 that is driven by a motor 10, which is secured to the frame 1. As is apparent from FIG. 1 a motor 10 is provided only on one side of the frame 1 and a second pinion 9', which corresponds to the pinion 9, is provided on the other side of the frame and is operatively connected by a synchronized shaft 11 to the drive motor 10. FIG. 2 shows another drive motor 12 which serves to drive the winding head 13, whereas the winding head 14 which is opposite to the winding head 13 is freely rotatably mounted to rotate with the winding head 13. A further drive motor 15 is provided on the other side of the frame 1 and serves to drive a winding head 16. A winding head 17 is provided, which is opposite to the winding head 16 and is freely rotatable. A traversing motor 18, 19, 20 or 21 is associated with each winding head 13 to 17. Except for the fact that the head 13 is driven by the motor 12 and the head 16 is driven by the motor 15, all winding heads 13 to 17 are identical. For this reason only the winding head 13 which is driven by the drive motor 12 will now be described in more detail with reference to FIG. 2.

It is apparent from FIG. 2 that the drive motor 12 is flanged to the outer wall 22 of the hollow disk 6. A cogged vee belt 26 is trained around a pulley 25, which is secured to the shaft 24 of the motor 12 between the two walls 22 and 23 of the hollow disk 6. The toothed vee belt 26 is also trained around a gear 27, which is mounted on a retaining ring or bearing bushing 28, which is connected by ball bearings 29 to a carrier 30, which consists of two parts and is secured to the walls 22 and 23. The retaining ring 28 is secured to a sleeve 31, which is formed with a groove 32, which contains a key 33, which is firmly screw-connected to the retaining ring 28 so that the sleeve 31 is axially displaceable relative to the mounting ring. That axial displacement is facilitated by two annular bearings 34 and 35. Two linear ball bearings 36 and 37 have been inserted into the sleeve 31 at opposite ends and carry a mounting pin 38, which may be described as a drive pin, which is formed with a groove 39, which receives a key 40, which is screw-connected to the sleeve 31. The groove is not open at both ends but on that side of the drive pin 38 which is on the right in FIG. 2 terminates at A. The drive sleeve 38 has a central bore 41. A rod extends through the bore and at that end which protrudes out of the drive sleeve on the right engages one arm of an expanding lever 43, the other arm of which engages an expansible part 44 of an adapter 45. In response to a movement of the rod 42 to the right the expanding lever 43 will apply pressure to the expansible part 44 of the adapter 45 so that the core tube 46 which has been fitted on the adapter will be fixed thereon. To permit the rod 42 to be extended, the rod 42 is connected at its left-hand end to a piston 47, which is slidably mounted in a housing 48. To move the piston, compressed air is blown into the cylinder space 50 through the rotary lead-through 49. The piston 47 is returned by compression springs 51. The housing 48 is mounted on the left-hand end of the drive sleeve 38, which is surrounded on that region by a bearing 52, which is held by a holder 53. The holder 53 is connected to a nut 54, which protrudes outwardly through a slot 55, which is formed in a protective tube 56 that is connected to the carrier 30. A screw 57 has been screwed into the nut 54 and is rotatably mounted at one end in a bracket 58, which is connected to the protective tube 56, and at its other end is rotatably mounted in the carrier 30. In that region, close to the carrier 30, a belt pulley 59 is secured to the screw 57. A cogged vee belt 57 is trained around the belt pulley 59 and operatively connects the latter to the belt pulley 61 that is driven by the traversing motor 18, which is secured to the left-hand wall 22 of the hollow disk 6.

It is also apparent from FIG. 2 that the sleeve 31 is provided at both ends with respective covers 62 and 63, which are intended to prevent the linear ball bearings 36 and 37, the groove 32 and the bearings 35 are clogged by dirt. In the position shown in FIG. 2 the cover 63 closes a protective tube 64 that is connected to the carrier 30 is closed at its forward end by the cover 63 in the position shown in FIG. 2. There is also a compression spring 65, which bears at one end on the mounting ring 28 and at the other end on the cover 63 when the drive sleeve 38 has been extended the compression spring 65 will move the cover 63 and the sleeve 31 connected to the cover 63 to the right to such an extent that the key 33 is engaged by the lefthand cover 62, which is also secured to the sleeve 31. It is assumed a coil 66 has just been wound when the apparatus is in the position shown in FIG. 2. To permit a removal of that coil, the cylinder chamber 50 is first opened to the atmosphere for a pressure relief. The spring 51 will then move the piston 47 and the rod 42 to the left so that the expanding lever 43 will be released and the core tube 46 and the wound coil 66 surrounding that core tube will be released by the adapter 45. At that time the traversing motor 18 will be turned on to rotate in such a sense that the nut 54 will move to the left in the direction indicated by the arrow so that the drive sleeve 38 is also moved to the left until the point A at the end of the groove 39 reaches and engages the key 40. As the movement of the drive sleeve 38 to the left is continued, the key 40 causes the sleeve 31 and the two covers 62 and 63 to be moved to the left. The inside diameter of the protective tube 64 is so large that even the largest adapter 45 which is contemplated can be retracted into the interior of the protective tube 64. The wound coil 66 which has previously been supported is then carried away. To mount a new core tube 46, the drive sleeve 38 and the sleeve 31 which supports the drive sleeve are extended by a reversal of the operations described hereinbefore. The drive motor 12 can then be turned on to rotate the drive sleeve so as to wind a new coil.

Figure 2:
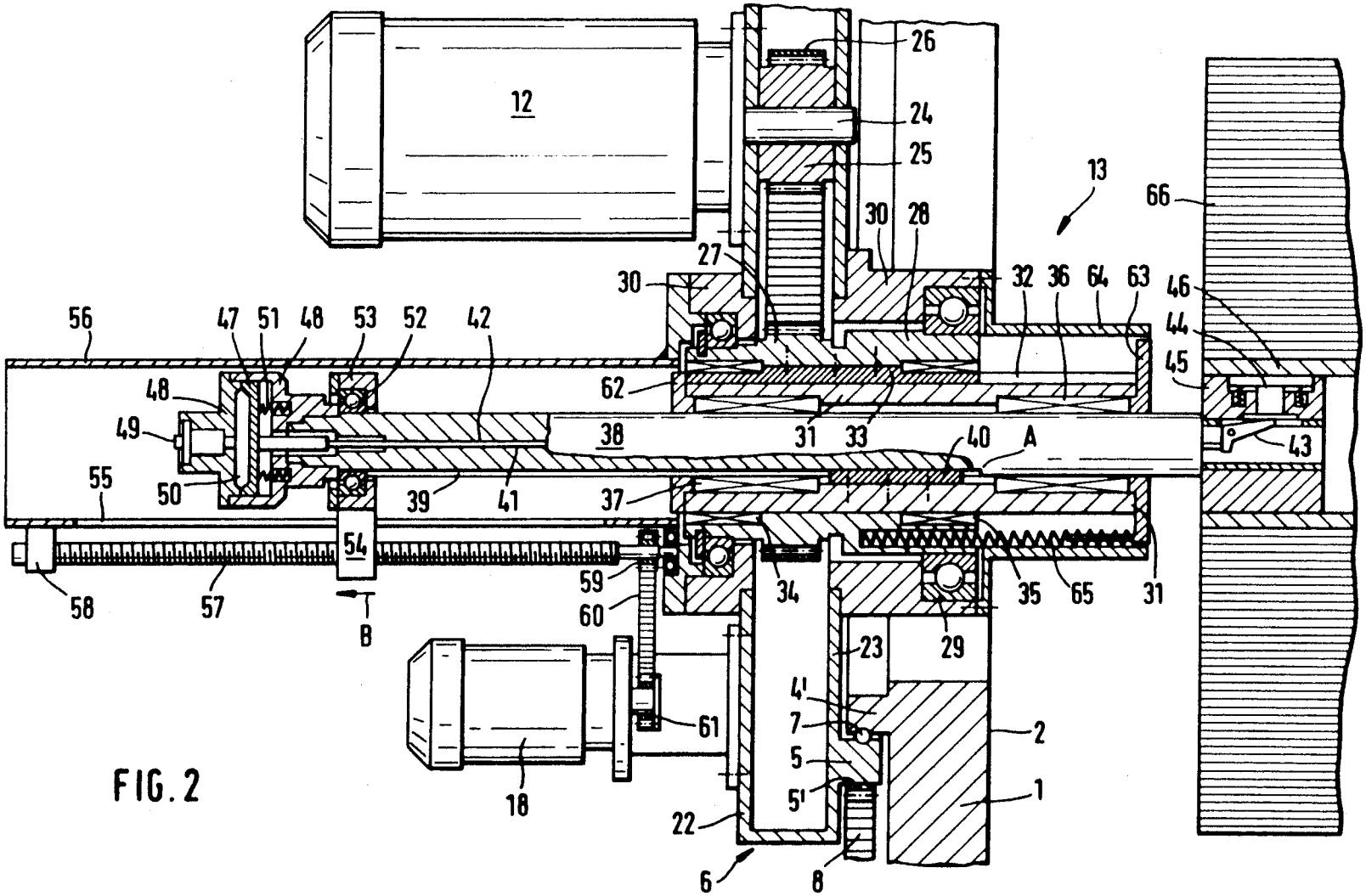
FIG. 2 is an enlarged sectional view showing the lower left-hand portion of the traversing winder shown in FIG. 1.

With reference to FIG. 1 it is pointed out that each completely wound coil will be removed from the winder, as a rule, when the coil is in the lower position shown in FIG. 1. During the removal of the wound coil 66 shown in its lower position, the two upper winding heads 16 and 17 are already operated to wind a new coil 67. As soon as the lower wound coil 66 has been removed and a new core tube 46 has been mounted, the hollow disk 6 has been rotated through 180 degrees relative to the stationary frame so that the positions in which the winding heads 13 and 14 are moved to the upper position and the winding heads 16 and 17 are moved to the lower position in FIG. 1.

We claim:

1. An apparatus for winding webs on core tubes, which apparatus comprises mutually opposite trunnions, which are aligned with each other and rotatably mounted in a machine frame and at their confronting ends are provided with mandrels, which are adapted to be inserted into the core tubes and to be forced against said core tubes, wherein each of said trunnions is mounted in an axially displaceable bearing sleeve and the apparatus also comprises a first drive means for axially driving at least one of the mutually opposite trunnions selectively in forward and reverse directions between retracted and extended positions in the respective bearing sleeve, characterized in that each trunnion is axially slidably and non-rotatably mounted in the respective bearing sleeve, and each bearing sleeve is axially slidably and non-rotatably mounted in a bearing bushing which is rotatably mounted in the machine frame and wherein a second drive means is provided for rotating one of the bearing bushings thereby also rotating the respective bearing sleeve and trunnion characterized in that the bearing sleeve is provided at both ends with discs, comprising an inner disc and an outer disc both of which are formed with central bores through which the trunnion extends, and at least one compression spring is compressed between the outer disc and the bushing and urges the bearing sleeve toward an extended position.

2. An apparatus according to claim 1, characterized in that the inner disk constitutes a stop which bears on a key, which is screw-connected to the bearing bushing to limit outward movement of the bearing sleeve, and said key is guided in a longitudinal groove of the bearing sleeve.

3. An apparatus according to claim 1, characterized in that the machine frame comprises a carrying wall, which is connected with a protective tube for receiving the outer disk and the mandrel.

* * * * *